US008843246B2

(12) United States Patent
Fraser et al.

(10) Patent No.: US 8,843,246 B2
(45) Date of Patent: Sep. 23, 2014

(54) CRUSH ZONES FOR UNMANNED VEHICLES AND METHODS OF USING THE SAME

(75) Inventors: Spencer Fraser, Medicine Hat (CA); Siobhan K. Penzes, Medicine Hat (CA)

(73) Assignee: Meggitt Training Systems Canada Inc. (CA)

( * ) Notice: Subject to any disclaimer, the term of this patent is extended or adjusted under 35 U.S.C. 154(b) by 174 days.

(21) Appl. No.: 13/361,773

(22) Filed: Jan. 30, 2012

(65) Prior Publication Data

US 2013/0197717 A1 Aug. 1, 2013

(51) Int. Cl.
*B63B 59/02* (2006.01)

(52) U.S. Cl.
CPC ..... *B63B 59/02* (2013.01)
USPC ..... 701/2; 701/21; 114/219; 293/133

(58) Field of Classification Search
CPC ..... B60R 19/34
USPC ..... 701/2, 23–28, 21; 114/2, 3, 13, 219; 89/36.12; 293/106, 133; 116/32
See application file for complete search history.

(56) References Cited

U.S. PATENT DOCUMENTS

| | | | | | |
|---|---|---|---|---|---|
| 2,042,689 | A | * | 6/1936 | Wallace | 116/32 |
| 2,646,016 | A | * | 7/1953 | Wilson | 116/32 |
| 3,079,884 | A | * | 3/1963 | Miller | 114/219 |
| 3,307,868 | A | * | 3/1967 | Blank | 293/133 |
| 4,272,114 | A | * | 6/1981 | Hirano et al. | 293/133 |
| H0485 | H | * | 7/1988 | Rousseau | 273/362 |
| 5,314,229 | A | * | 5/1994 | Matuzawa et al. | 296/187.09 |
| 5,461,982 | A | * | 10/1995 | Boyer, III | 102/513 |
| 5,803,514 | A | * | 9/1998 | Shibuya et al. | 293/133 |
| 6,106,039 | A | * | 8/2000 | Maki | 293/132 |
| 6,536,365 | B1 | * | 3/2003 | Horton | 114/244 |
| 6,609,475 | B2 | * | 8/2003 | Thomas et al. | 114/219 |
| 6,799,794 | B2 | * | 10/2004 | Mochidome et al. | 296/187.03 |
| 7,029,044 | B2 | * | 4/2006 | Browne et al. | 293/137 |
| 7,207,283 | B2 | * | 4/2007 | Locke | 114/219 |
| 8,062,082 | B1 | | 11/2011 | Anderson et al. | |
| 8,469,417 | B2 | * | 6/2013 | Di Modugno | 293/133 |
| 2003/0111894 | A1 | | 6/2003 | Wattenburg et al. | |
| 2006/0237976 | A1 | | 10/2006 | Glasgow et al. | |

(Continued)

FOREIGN PATENT DOCUMENTS

| | | | |
|---|---|---|---|
| DE | 29709826 U1 | * | 8/1997 |
| FR | 329568 | * | 2/1903 |

(Continued)

OTHER PUBLICATIONS

Jane's Navy International, "White of their Eyes: gunners train on fast boat threats", Apr. 1, 2011, vol. 116 No. 003, Dialog print out, 22 pages.*

(Continued)

*Primary Examiner* — Behrang Badii
*Assistant Examiner* — David Testardi
(74) *Attorney, Agent, or Firm* — Dickstein Shapiro LLP

(57) ABSTRACT

An unmanned vehicle comprising a body and a crush zone combined with the body. In a preferred embodiment, the crush zone is a crushable bumper connected to the body. The unmanned vehicle including the crush zone may be used to swarm a vehicle in training during a training exercise. Particularly, the unmanned vehicle including a crushable bumper may be used to swarm a warship during a live fire exercise.

18 Claims, 8 Drawing Sheets

(56) References Cited

U.S. PATENT DOCUMENTS

| | | | | |
|---|---|---|---|---|
| 2007/0176442 | A1 * | 8/2007 | Mori et al. | 293/133 |
| 2008/0210817 | A1 | 9/2008 | Gregg et al. | |
| 2008/0238146 | A1 | 10/2008 | Nusier et al. | |
| 2009/0102234 | A1 | 4/2009 | Heatherington et al. | |

FOREIGN PATENT DOCUMENTS

| | | | | |
|---|---|---|---|---|
| FR | 1502887 | * | 10/1967 | |
| GB | 2139707 A | * | 11/1984 | F04B 43/08 |
| JP | 02080467 A | * | 3/1990 | C07D 5/00 |
| JP | 2006205841 A | * | 8/2006 | |
| WO | WO 00/51875 | * | 9/2000 | |

OTHER PUBLICATIONS

"Appendix E—Weapons Systems Description", 2009 Navy Cherry Point Range Complex Environmental Impact Statement (EIS), 2009, 106 pages, downloaded from http://www.agriculturedefensecoalition.org/sites/default/files/pdfs/17W__2009__Navy__Cherry__Point__Weapons__www.navycherrypointran...int__FEIS__Vol__1__Appendix__E.pdf.*

Business Wire—HSMST Image, Apr. 2013, downloaded from http://mms.businesswire.com/media/20130409006156/en/364711/5/120210__HSMST__Hit__1reduced.jpg?download=1.*

Bertram, Volker, "Unmanned Surface Vehicles—A Survey", Google Scholar Date 2008, downloaded from http://www.skibstekniskselskab.dk/public/dokumenter/Skibsteknisk/Download%20materiale/2008/10%20marts%2008/USVsurvey__DTU.pdf.*

Blume, Jeffrey, "Seaborne Target Overview", 2003, 41st Annual NDIA Targets UAV's & Range Operations Symposium and Exhibition, Nov. 18, 2003, 21 pages, downloaded from http://www.dtic.mil/ndia/2003targets/blume.ppt.*

Google Machine Translation of DE 29709826 U1 (original DE document published Aug. 14, 1997).*

JeepPatriot.Com forum post, "Accident bumper paint transfer fix", Sep. 14, 2009, downloaded from http://www.jeeppatriot.com/forum/showthread.php?t=25170.*

AmpM Insure forum post, "Minor paint transfer turns into a request for $600+", Nov. 15, 2007, downloaded from http://www.ampminsure.org/start/about3400.html.*

Google Translation of FR 329568 (original FR document published Feb. 20, 1903).*

International Search Report for Application No. PCT/CA2013/000063, filed Jan. 24, 2013, dated May 23, 2013.

* cited by examiner

CRUSH ZONES FOR UNMANNED VEHICLES AND METHODS OF USING THE SAME

The present patent document relates to crushable bumpers for unmanned vehicles and methods of using the same.

BACKGROUND

Ever since the attack on the USS Cole in 2000, the threat posed by Fast Inshore Attack Craft (FIAC) has been a central theme for western naval officers responsible for ship defense. The FIAC threat is often referred to as an "asymmetric threat," meaning that a swarm of small boats operated by a fanatical foe may overwhelm a major warship, much like a swarm of bees attacking a larger animal.

To be able to conduct threat representative live fire naval exercises, expendable kill targets that may be remotely operated have been developed. These expendable kill vehicles may be used to simulate a FIAC attack. One such expendable kill target is the unmanned vehicle known as the Hammerhead, which is designed and manufactured by Meggitt Training Systems. Hammerheads may be remotely operated and used to simulate a FIAC attack.

In one example of a FIAC simulated attack training exercise, one or more expendable kill targets may be remotely operated and directed towards the vehicle in training such as a warship. The warship tries to acquire and destroy the swarming expendable kill targets using live ammunition in a live fire training exercise. If one of the expendable kill targets can penetrate the defenses of the warship and strike the ship before being destroyed itself, then the warship has failed the training exercise. On the other hand, if all of the expendable kill targets are destroyed before any can strike the warship, then the warship has successfully completed the training exercise.

While in an ideal training exercise the expendable kill vehicle would actually try and strike the warship, current methods of training forbid the expendable kill vehicle from striking the warship for safety reasons. In current training methods, one of the major operating safety constraints of live fire exercises with unmanned vehicle targets is ensuring that the target does not strike one of the participating units. In the case of the Canadian and US Navy, there have been several instances of targets striking ships.

Although trying to strike and/or actually striking the ship would increase the reality of the training exercise, current methods forbid strikes for a number or reasons. Strikes to a ship typically happen in one of the most expensive areas to repair, the waterline. Repairing a hole at the waterline necessitates going into dry dock, which itself requires the de-ammunitioning and de-fueling of a warship. These two activities alone may cost over a million dollars in time and effort. In the case of the US Navy, this has led to proscriptive regulations that preclude bringing the target closer than 500 yards from the firing ship. This is known in navy parlance as "the bubble."

One method of making sure that the unmanned vehicles observe the bubble is to program them to cut engine power, either with software or hardware or both once they breach the bubble. However, even with both software and hardware preprogrammed cut-offs, the bubble still needs to be overly large to protect against "rogue drones." Rogue drones are unmanned vehicles that no longer respond to software or hardware commands. Because in many training exercises live fire may be used, the unmanned vehicles may suffer damage to the cut-off circuitry and may become unresponsive to cut-off instructions. Rogue drones pose a serious impact threat to participating vessels and therefore, the bubble must be made excessively large. Even with a large bubble, a software or hardware cut-off is not a fool proof solution to the impact problem.

Another problem with the bubble is that it creates a limit to the realism that may be achieved in the training exercises. Studies have shown that the average kill range of a Hammerhead has been less than 150 yards. In order to reduce the risk of impacts with participating vessels, the bubble has been established at as much as 500 yards. This creates an unrealistic training scenario for a number of reasons.

When the unmanned vehicles are farther from the vehicle in training, the ammunition has a longer flight time and thus, the erratic maneuvers of an agile unmanned vehicle make it more difficult to hit. Consequently, elimination of the threat of the unmanned vehicle is more likely to happen within a close proximity to the ship.

A bubble around the vehicle in training causes the unmanned vehicles to either significantly slow down or turn parallel to the vehicle in training when approaching. Slowing down and turning parallel to the vehicle in training at such close range makes the unmanned vehicle easier to target and drastically reduces the realism of the training methods The data obtained from training exercises gains in usefulness as the training exercise gains in realism. Data from training exercises may actually be harmful if the training exercise is not realistic enough because the data may give a false sense of security. Accordingly, when testing defense systems against the threat posed by unmanned vehicles, it is important that the test be as realistic as possible In order to make the training exercises against a FIAC threat more realistic, it is desirable to bring the high speed targets in close proximity to the participating vessel during training without incurring too high of a risk that the vessel will be damaged.

SUMMARY OF THE EMBODIMENTS

In view of the foregoing, an object according to one aspect of the present patent document is to provide crushable bumpers for use with unmanned surface vehicles and methods of using the same. Preferably the methods and apparatuses address, or at least ameliorate one or more of the problems described above. To this end, an unmanned vehicle that may be brought into close proximity to a vehicle in training without risk to substantial damage to the vehicle in training is provided. In one embodiment, the unmanned vehicle comprises: a body; and a crush zone combined with the body. In some embodiments, the crush zone is a crushable bumper connected to the body. In other embodiments, the crush zone may be integrated into the body.

In some embodiments, an unmanned vehicle is a surface vehicle designed for use on the open water. However in other embodiments, the unmanned vehicle may be designed for use on air or land or may even be a submersible. In a preferred embodiment, the unmanned vehicle is a target and may be used in live fire training exercises.

Preferably, the crush zone is designed to prevent substantial damage to a vehicle in training when the unmanned vehicle impacts the vehicle in training.

In different embodiments, the crush zone may take on different forms. In some embodiments, the crushable zone may further include a shock absorbent material on its exterior. In some embodiments, the crush zone includes a plurality of separate crush tubes each designed to crush under a different amount of force. However, in a preferred embodiment, the crush zone may be comprised of a single crush tube. If a single crush tube is used, the single crush tube may be designed to incur increased folds or buckling as impact forces increase.

In different embodiments, the cross section of the crush tubes may be any shape. For example, in some embodiments the crush tubes may be round while in other embodiments the crush tubes may be square. Other cross section shapes may also be used such as a triangle, hexagon, octagon or any other shape.

In another aspect of the embodiments of the present patent document, a method of performing a training exercise is provided. One embodiment of the method of performing a training exercise comprises: swarming a vehicle in training with an unmanned vehicle that includes a crush zone. In a preferred embodiment, a plurality of unmanned vehicles swarm the vehicle in training.

In some embodiments, the crush zone is designed to prevent substantial damage to a particular vehicle in training when impacted by the unmanned vehicle. In one embodiment, the minimum length of the crushable bumper is designed to be the distance between at least two structural members of the vehicle in training.

In some embodiments, the vehicle in training may be marked by the unmanned vehicle if an impact occurs. For example, the unmanned vehicle may project a dye or other type of marker onto the side of the vehicle in training upon impact.

In yet another aspect of the embodiments of the present patent document, a crushable bumper is provided. In some embodiments, the crushable bumper comprises: a crush zone designed to crush under a compression force; a bumper; and a dye designed to leave a mark on an object when impacted by the crushable bumper.

Preferably, the crushable bumper is designed to prevent substantial damage to a vehicle in training when impacted by the unmanned vehicle. Accordingly, in some embodiments, the minimum length of the bumper is designed to be the distance between at least two structural members of the vehicle in training. This ensures the crushable bumper will impact at least one structural member of the vehicle in training regardless of the position of impact.

In some embodiments of the crushable bumper, the crushable bumper may further comprise shock absorbent material attached to the exterior of the bumper. In yet other embodiments, the crush zone includes a plurality of separate crush tubes each designed to crush under a different amount of force. In still other embodiments, the crush zone is made up of a single crush tube.

In some embodiments, the crush zone may be integrated into the body of the unmanned vehicle, while in other embodiments the crush zone may be part of a bumper connected to the body of the vehicle. Accordingly, in some embodiments the crush zone may be removable or replaceable while in other embodiments the crush zone is not removable or replaceable.

As described more fully below, the apparatus and methods provide the ability to bring expendable kill targets within close proximity to a training vehicle while ensuring its safety. Further aspects, objects, desirable features, and advantages of the apparatus and methods disclosed herein will be better understood from the detailed description and drawings that follow in which various embodiments are illustrated by way of example. It is to be expressly understood, however, that the drawings are for the purpose of illustration only and are not intended as a definition of the limits of the claimed invention.

DETAILED DESCRIPTION OF THE EMBODIMENTS

Ever since the USS Cole was attacked in 2000, the threat that small unmanned vehicles may pose has been more clearly recognized. In order to help understand and reduce the threat, militaries, navies and other organizations have tried to train and test their vehicles' defense systems against such an attack. Meggitt has developed a number of unmanned vehicles, including the Hammerhead, which may be used for exactly this type of training exercise.

Whenever a training exercise that includes an unmanned vehicle approaching a vehicle in training is performed, there is always a chance that the unmanned vehicle may accidently impact the vehicle in training. Because it is not desirable to cause any damage to the vehicle in training, the embodiments of unmanned vehicles 12 disclosed herein include a crush zone combined with the body of the vehicle. The crush zone is designed to buckle and dissipate enough of the kinetic energy during impact to prevent damage to the vehicle in training. In a preferred embodiment, the crush zone is designed with only the safety of the vehicle in training in mind and is not designed to increase the survivability of the unmanned vehicle. In other embodiments, the crush zone may be designed with the safety and vehicle and training and the survivability of the unmanned vehicle in mind.

Figure 1:
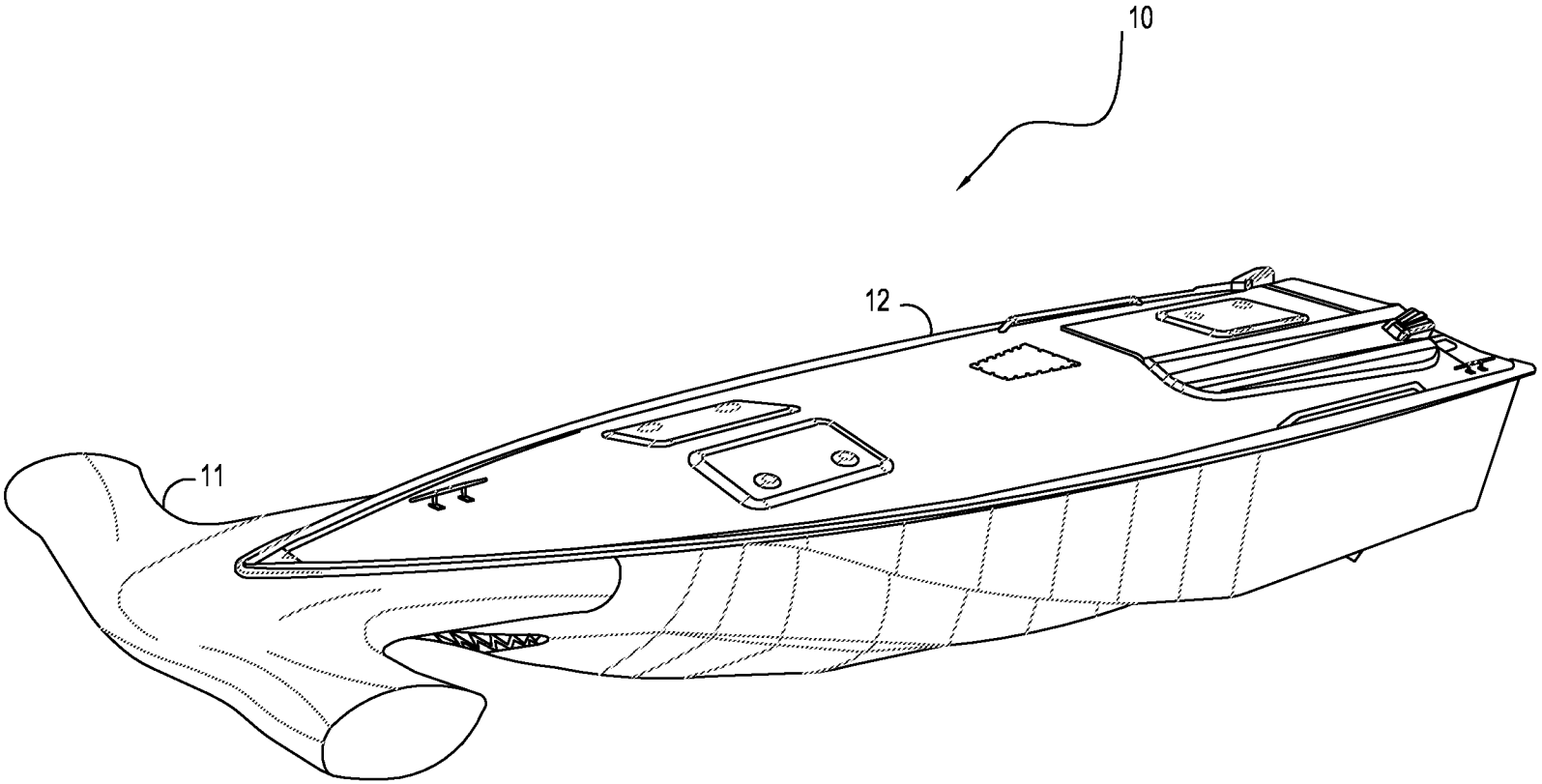
FIG. 1 illustrates an embodiment of an unmanned vehicle including a crushable bumper.

FIG. 1 illustrates an embodiment 10 of an unmanned vehicle 12 with a crushable bumper 11 that includes a crush zone. In the embodiment shown in FIG. 1, the crushable bumper 11 is attached to the front of the unmanned vehicle 12 and stylized like the head of a hammerhead shark. The crushable bumper 11 is designed to prevent substantial damage to a vehicle in training if/when the unmanned vehicle 12 impacts the vehicle in training.

The unmanned vehicle shown in FIG. 1 is a Hammerhead unmanned surface vehicle designed to operate on the open water. However, in other embodiments, the unmanned vehicle 12 may be an unmanned air vehicle or an unmanned ground vehicle. In yet other embodiments, unmanned vehicle 12 may be a submersible vehicle such as a submarine or other type of submersible vehicle. In still other embodiments, the unmanned vehicle 12 may be able to maneuver via combinations of air, ground and water.

The crush zone in the embodiment illustrated in FIG. 1 is integrated into a crushable bumper 11 attached to the front of the unmanned vehicle 12. However, in other embodiments, the crush zone may be any portion of the unmanned vehicle designed to buckle in order to prevent damage to another vehicle upon impact. For example, the crush zone may be integrated into the body of the unmanned vehicle instead of being part of an attached bumper. The crush zone is a portion of the vehicle or portion of an attachment to the vehicle that is designed to buckle during an impact before other portions of the structure buckle, yield, shear, or break. This allows the crush zone to absorb the kinetic energy of the impact. In some embodiments, the crush zone may be a portion of the structure that is composed of a material that is designed to buckle under a stress less than the stress required to buckle, yield, shear or break other portions of the structure.

In some embodiments, a crush zone may be achieved simply through the choice of material. A portion of the structure may be designed from a softer less brittle material that yields or buckles under less force than other portions of the structure. Accordingly, the crush zone will buckle first during an impact.

In other embodiments, the crush zone may be achieved by purposely weakening portions of the structure with crush initiators such as grooves or dimples in the structure designed to initiate buckling in a particular area. In yet other embodiments, crush zones may be created through structurally designing points of weakness designed to buckle first during an impact. In yet other embodiments, combinations of the above techniques may be used.

Figure 2:
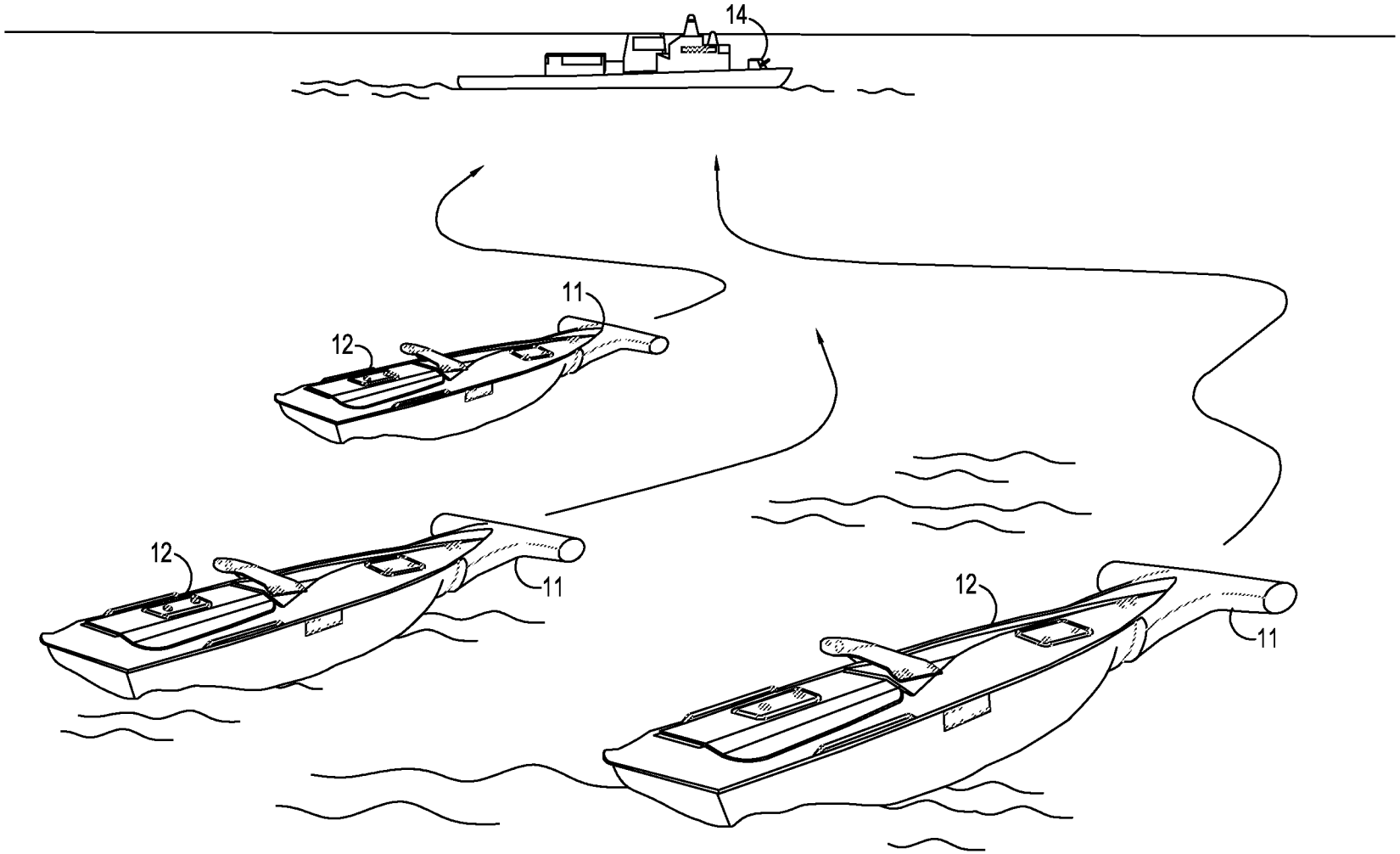
FIG. 2 illustrates a plurality of unmanned vehicles swarming a vehicle in training.

FIG. 2 illustrates a plurality of unmanned vehicles 12, each including a crushable bumper 11, swarming a vehicle in training 14. In order to test different defense systems against an attack from an unmanned vehicle 12, one or more unmanned vehicles 12 may swarm a vehicle in training 14. As shown in FIG. 2, the vehicle in training is a Navy frigate and the unmanned vehicles are small surface vessels. However, in other embodiments, the vehicle in training 14 may be any type of vehicle, including land sea or air vehicles desirous of testing or training a defense system against an enemy attacker and the unmanned vehicles may similarly be any type of land, air, or sea vehicle or combinations thereof. For example, the vehicle in training 14 may be a military vehicle, a cargo vehicle, a warship or any other type of vehicle with a defense system.

In one example the vehicle in training 14 may be a land vehicle, such as a tank, and the unmanned vehicles may also be land vehicles. In another embodiment, the vehicle in training may be an aircraft and the unmanned vehicles may be unmanned air ships such as small remote controlled jet planes. In yet another embodiment, the unmanned vehicles 12 may be a combination of surface vehicles, such as the Hammerhead, in combination with unmanned air vehicles swarming a Navy frigate like the one shown in FIG. 2. In other embodiments, other combinations of unmanned land, air and sea vehicles may be used to swarm a land, air or sea based vehicle in training 14.

During the training methods described and taught herein, an unmanned vehicle 12 is remotely controlled to swarm the vehicle in training 14. Swarming a vehicle in training 14, as used herein, may include simply trying to come in close proximity to the vehicle in training 14, actually attacking the vehicle in training 14 with some non-lethal weapon, or trying to impact the vehicle in training 14. Swarming may be performed by a single unmanned vehicle 12 or a plurality of unmanned vehicles 12.

In a preferred embodiment, when an unmanned vehicle 12 swarms the vehicle in training 14, the unmanned vehicle 12 approaches the vehicle in training 14 with erratic or evasive movements to make the unmanned vehicle 12 more difficult to acquire or kill. In some embodiments, the unmanned vehicles 12 may also use stealth in their approach to the vehicle in training 14. For example, rather than erratically maneuvering in plain sight, the unmanned vehicle 12 may try and sneak up on the vehicle in training 14. If the approach of the unmanned vehicle 12 is detected by the vehicle in training 14, the unmanned vehicle 12 may commence evasive maneuvers. In a preferred embodiment, a plurality of unmanned vehicles 12 swarm the vehicle in training 14 simultaneously. All such techniques of approach by the unmanned vehicles 12 are meant to be included in the definition of "swarm" as used herein.

The methods of training described herein may be used to test various different types of defense systems. For example, swarming a vehicle in training 14 may test the vehicle in training's ability to acquire and track one or more targets. Systems such as RADAR, SONAR or other acquisition systems may be tested.

In addition to testing the technological aspects of a vehicle in training's defense systems, the vehicle in training's human factors may also be tested. For example, the vehicle in training's crew's ability to handle one or more targets may be tested, including their ability to direct and command weapon systems to acquire and eliminate one or more threats.

Numerous ways of tracking or scoring the vehicle in training's ability to eliminate the threat of unmanned vehicles 12 may be used in different embodiments. For example, the vehicle in training 14 may test its defense systems by actually trying to eliminate the unmanned vehicles 12 with live ammunition. The unmanned vehicles 12 may be targeted with live ammunition until they are destroyed or disabled. In other embodiments, scoring may be achieved by an emission and sensor system. Lasers mounted on the vehicle in training 14 along with sensors mounted on the unmanned target vehicles 12 is one example of an emission and sensor system. The sensors on the unmanned target vehicles 12 may be used to detect when the unmanned vehicle 12 was acquired and hit by the laser system. As an analogy, one embodiment of laser and sensor systems used for scoring may be thought of as a sophisticated form of laser tag.

In other embodiments, the unmanned vehicle 12 may be outfitted with special reflective surfaces that allow the vehicle in training 14 to have both the emission system and the sensors. In such an embodiment, the sensor system is designed to detect the laser light reflected from the unmanned vehicle 12 when illuminated by the laser on the vehicle in training 14. In other embodiments, other forms of tracking and scoring may be used.

The unmanned vehicles 12 shown in FIG. 1 and FIG. 2 include a crush zone in the form of a crushable bumper 11 stylized like the head of a hammerhead shark. There is no requirement that the embodiments of crushable bumpers 11 described herein be stylized. In various embodiments, the crush zone may be purely functional with no styling, while in other embodiments, the crush zone may be stylized as shown in FIGS. 1 and 2.

Figure 3:
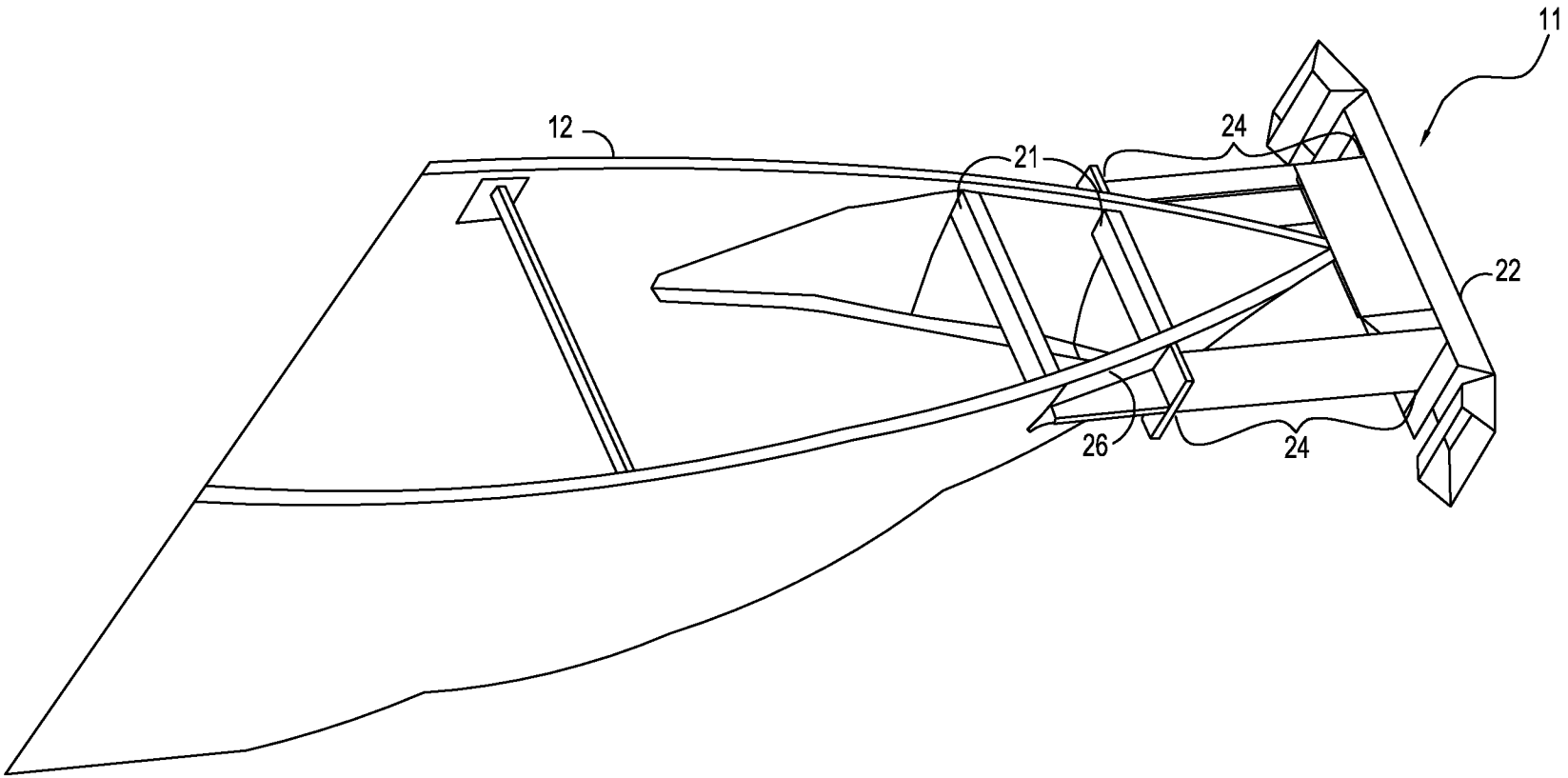
FIG. 3 illustrates the hull of an unmanned vehicle with a crushable bumper assembly attached.

FIG. 3 illustrates the hull of an unmanned vehicle 12 with a crushable bumper 11 attached. The embodiment of the crushable bumper 11 shown in FIG. 3 includes a bumper 22, a crush zone 24, and a hull attachment 26. Cross beams 21 may also be added to the hull between hull attachment points 26 to further help prevent the crushable bumper 11 from shearing from the hull upon impact.

Crush zone 24 is designed to crush upon impact between the unmanned vehicle 12 and another object. When the crush zone 24 buckles, it absorbs the kinetic energy of the impact. The crush zone 24 is designed to prevent substantial damage to the vehicle in training when impacted by the unmanned vehicle. In some embodiments, the crush zone 24 may be specially designed to prevent substantial damage to a specific vehicle in training 14 or type of vehicle in training.

The crushable bumper 11 may be made of any material or any combination of materials. In a preferred embodiment, the crush zone 24, bumper 22, and hull attachment 26, are all made from metal. Even more preferably, the crush zone 24, bumper 22, and hull attachment 26 are all made from aluminum. The aluminum may be any type of aluminum but preferably is 6063 aluminum with a O or T4 temper. However in other embodiments, the crush zone 24, bumper 22, and hull attachment 26 may be made from other materials. For example, some portions of the crushable bumper 11 may be made from steel or other metals. The crush zone 24 is preferably made from a material that is capable of predictable crushing or buckling. T6 aluminum may be too brittle for use in some embodiments and therefore, the ductility of T4 aluminum is preferable for crush zone 24. In addition to the tempers of aluminum listed above, other materials may be used. Other materials that may be used include but are not limited to 6061 aluminum in various tempers such as O, T4 and T6, other tempers of 6063 aluminum such as T6 and others, other types of aluminum and tempers, and various other metals.

The crush zone 24, bumper 22, and hull attachment 26 may be made from different materials. From a mechanical engineering standpoint, the design of the crushable bumper must be such that the crush zone 24 crushes or buckles upon impact. Accordingly, the bumper 22 and hull attachment 26 must be designed with sufficient rigidity and integrity such that they do not fail before the crush zone 22 buckles. A failure in a portion of the crushable bumper 11 other than the crush zone 24 may render the crush zone 24 ineffective. To this end, the materials, structural design, and attachment of the crushable bumper 11 should be carefully selected to ensure the crush zone 24 buckles during an impact of appropriate magnitude.

In addition to a crush zone 24, the crushable bumper 11 may include other shock absorbing features. For example, the structural components of the crushable bumper 11 may be covered in foam, rubber, neoprene, or any other shock absorbing material to help further absorb or dissipate the kinetic energy during an impact. Covering all or a portion of the structural components of the bumper 11 in a shock absorbing material helps reduce damage during slower impacts, when not enough energy exists to buckle the crush zone 24. Covering all or a portion of the structural components of a crushable bumper 11 also helps protect it from corrosion. As shown in FIG. 1, the shock absorbent material covering the crushable bumper 11 may be stylized.

In other embodiments, the crushable bumper 11 may not be covered in a shock absorbent material but may have additional shock absorbent material attached to its exterior. For example, the crushable bumper 11 may have large strips of rubber or foam on its exterior rather than being covered.

In some embodiments, the crush zone 24 may also be designed to be removable from the unmanned vehicle 12. For example, the crushable bumper 11 may be bolted on, screwed on, or attached with some other removable fastener that allows the crushable bumper 11 to be removed from the unmanned vehicle 12. Designing the crushable bumper 11 to be removable allows it to be easily replaced if damaged. Designing the crushable bumper 11 to be removable also allows the unmanned vehicle 12 to be sold with or without the crush zone 24. In other embodiments, the crush zone 24 may not be easily removable. For example, the crush zone 24 may be integrated into the unmanned vehicle's body or frame or in the case of a crushable bumper 11, the bumper may be attached using a non-replaceable fastener such as a weld.

Figure 4:
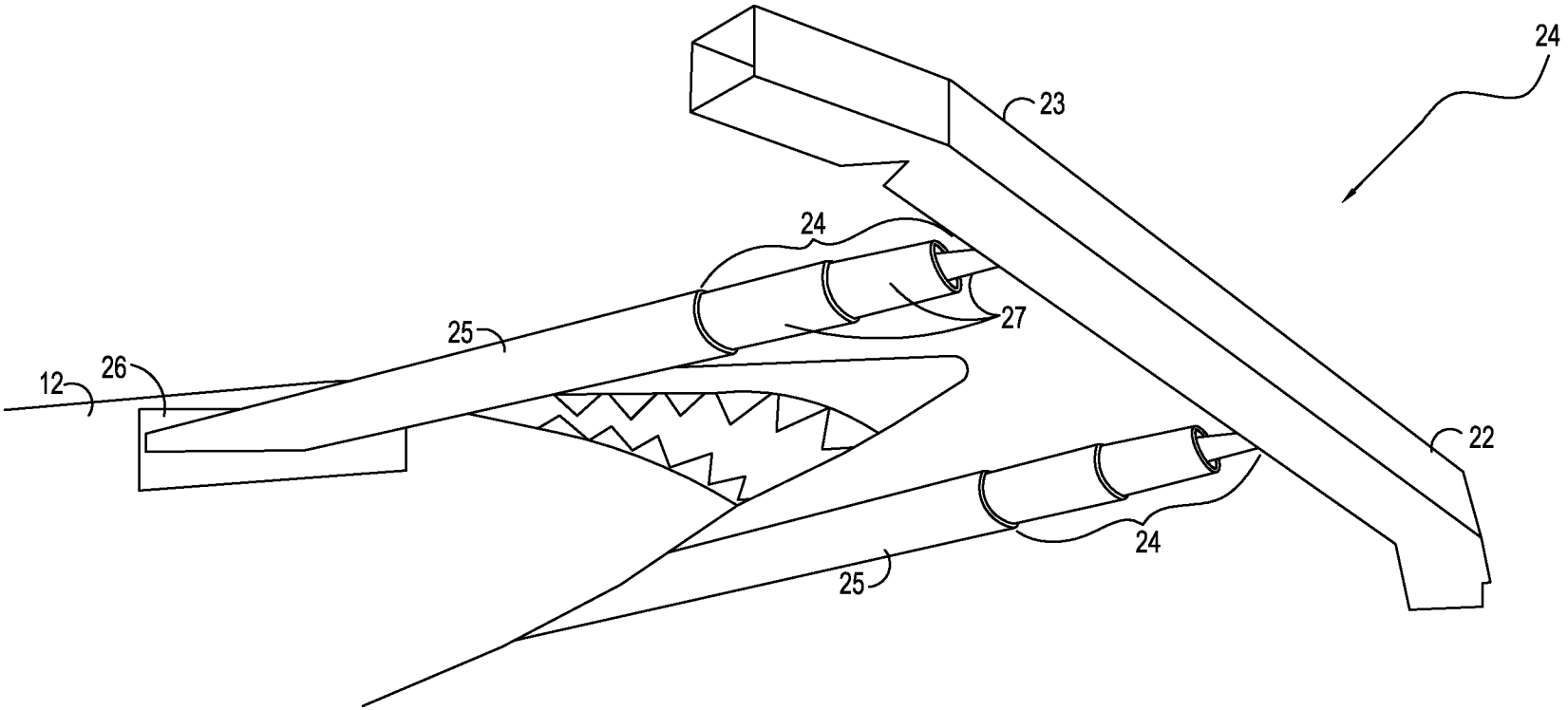
FIG. 4 illustrates the hull of an unmanned vehicle with a crushable bumper assembly attached.

FIG. 4 illustrates the hull of an unmanned vehicle 12 with a crushable bumper 11 assembly attached. The crushable bumper design in the embodiment in FIG. 4 consists of an aluminum bumper box 23 that is attached to a fiberglass hull by two main support arms 25. Each support arm 25 includes a crush zone 24 and a steel support arm. The crush zone 24 in the embodiment of FIG. 4 is constructed of three concentric aluminum crush tubes 27. The entire bumper system is then covered with self-healing rubber. Upon impact, the crush tube 27 with the smallest diameter buckles first; if enough energy was not absorbed, the middle crush tube 27 would collapse; and if necessary, the final crush tube 27 with the largest diameter would buckle. Using multiple crush tubes 27 instead of single crush tube allows the crush zone 24 to function in both low and high velocity impacts.

In different embodiments, the crush zone 24 may be designed to buckle using different types of buckling. In an embodiment that uses concentric circular crush tubes 27, concertina bucking (axisymmetric) is preferred. In other embodiments, other buckling types may be used including: diamond buckling (asymmetric), mixed buckling (asymmetric and axisymmetric) or any other geometric form of buckling. If the crush tubes 27 are not circular, another form of buckling other than concertina may be preferable. For example, if crush tubes 27 with a square or box cross section are used, diamond buckling may be preferred.

In order to reduce the initial force needed to initiate buckling, some embodiments of crush zone 24 may include crush initiators. Crush initiators are specific weakening points in the structure of the crush zone that reduce the initial force needed to begin buckling. Examples of crush initiators include grooves or dimples, which may be formed into the walls of the crush tube.

Although in the embodiment shown in FIG. 4 a plurality of crush tubes 27 are used to create crush zone 24, in other embodiments a single crush tube 27 may be used. In yet other embodiment, crush zone 24 may not use crush tubes at all. For example, in some embodiments a portion of the structure of the vehicle or bumper may be designed to buckle upon impact.

Figure 5:
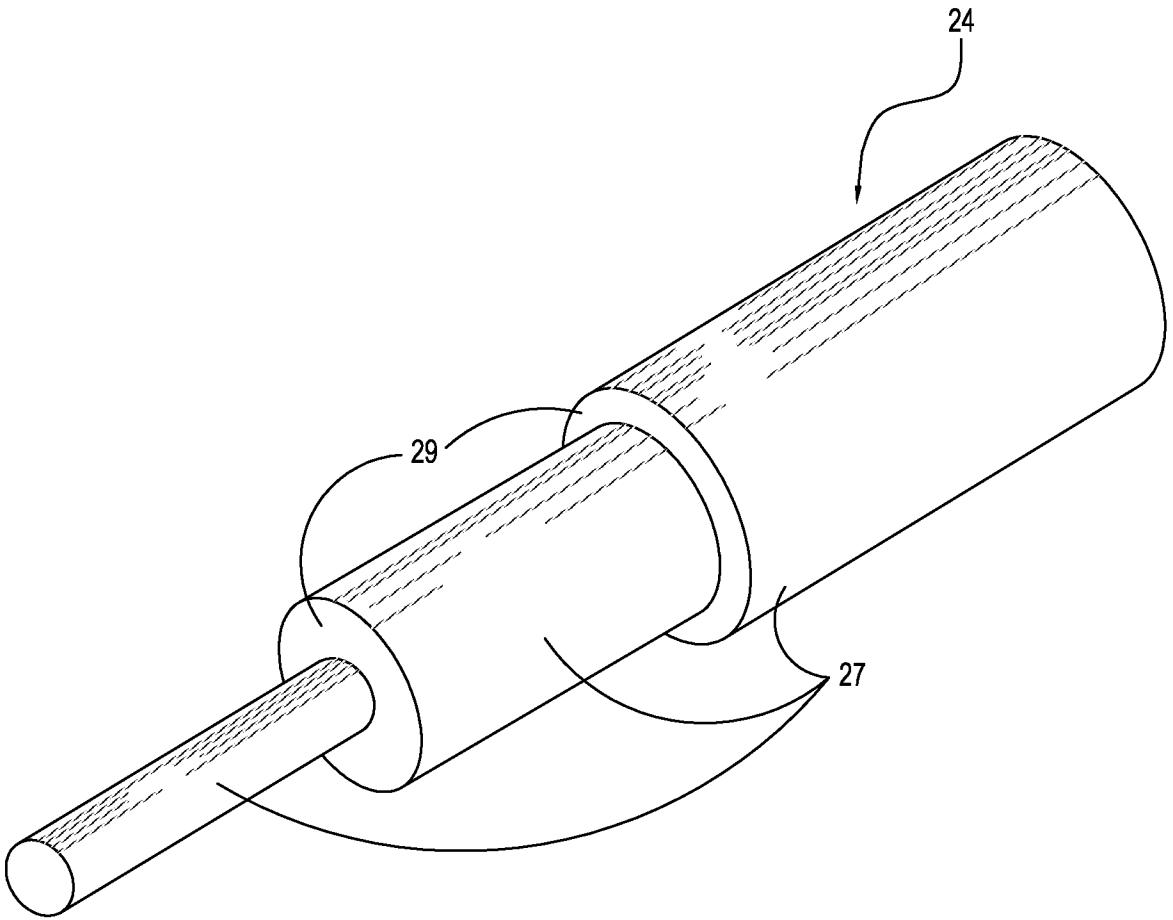
FIG. 5 illustrates a view of the crush zone of the embodiment of the crushable bumper shown in FIG. 4.

FIG. 5 illustrates a view of the crush zone 24 of the embodiment of the crushable bumper shown in FIG. 4. The embodiment of crush zone 24 shown in FIG. 5 includes three concentric crush tubes 27 and two collar assemblies 29 to interconnect the crush tubes 27. In a preferred embodiment, the crush tubes 27 are welded to the collars 29; however, other forms of attaching crush tubes 27 and collars 29 may be used. In designing crush zone 24, collars 29 and their associated welds must be strong enough to allow each crush tube 27 to completely crush. If the collars 29 and their associated welds begin to shear before the crush tubes 27 completely buckle, then the crush zone 24 will not absorb as much energy as predicted.

Rather than using multiple interconnected crush tubes 27 of varying diameters and wall thickness, a single crush tube 27 may be used. A single crush tube 27 may be designed to support varying degrees of crush force. For example, a single crush tube 27 may be conically shaped or may have a tapered wall thickness. Using a single crush tube 27 is preferable in some embodiments because a single crush tube 27 eliminates the need for collars 29 and their associated welds.

Figure 6:
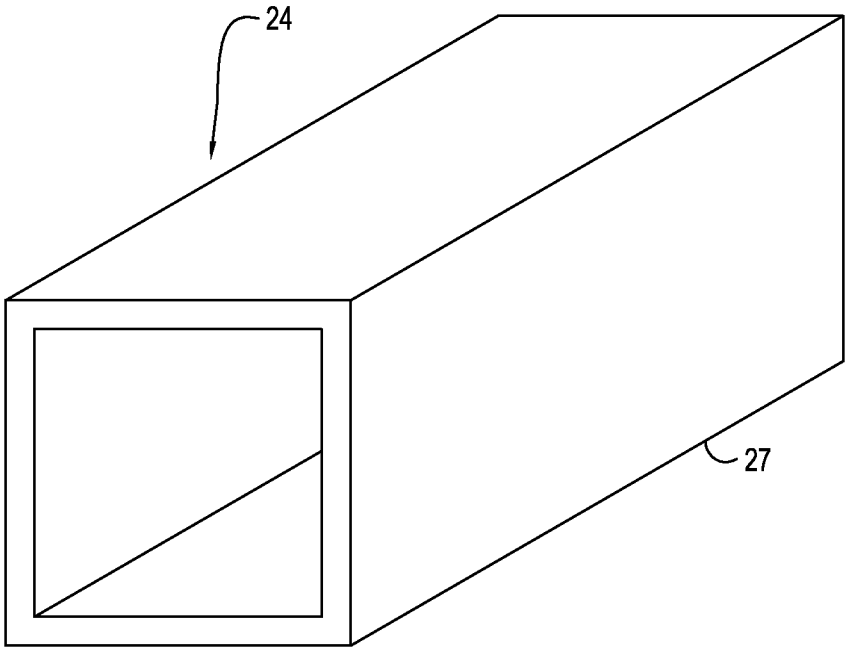
FIG. 6 illustrates an example of a crush zone made up of a single crush tube.

FIG. 6 illustrates an example of a crush zone 24 made up of a single crush tube 27. In a preferred embodiment, the crush zone 24 is made from a single crush tube 27. In a preferred embodiment, the single crush tube 27 has a square cross section. However, in other embodiments, other cross sections may be used. Also in a preferred embodiment, the square crush tube 27 is designed to buckle in a diamond pattern during compression. However in other embodiments, other forms of buckling may be used.

Different levels of kinetic energy may be absorbed based on the number of folds or the amount of buckling incurred by the crush tube during impact. Increasing energy absorption as a result of an increased number of folds is especially useful when using a single crush tube 27 for crush zone 24. For example, at low speeds, when not much kinetic energy needs to be absorbed, the single crush tube 27 may only incur a few folds when it buckles. However, if a high speed impact occurs and a lot of kinetic energy needs to be absorbed, the single crush tube 27 may incur an increased number of folds to absorb the additional kinetic energy.

In embodiments that include crush tubes 27, the diameters, lengths, and wall thicknesses of the crush tubes 27 are designed based on the amount of force needed to begin buckling each tube and the amount of energy each tube needs to absorb. The amount of energy the tubes need to absorb will be based on the maximum impact speed and weight of the unmanned vehicle 12 along with the maximum allowable impact forces a particular vehicle in training 14 can sustain without damage.

Table 1, lists some exemplary lengths, wall thicknesses, and diameters for a bumper assembly that includes three round concentric crush tubes 27 designed to prevent a localized pressure above 10,000 $lb_f$ for a Hammerhead Unmanned Vehicle impacting at a maximum of 28 knots. In other embodiments, other lengths, wall thickness and diameters may be used.

TABLE 1

| | Length (in) | Outer Diameter (in) | Wall Thickness (in) |
|---|---|---|---|
| Crush Tube 1 | 7.9 | 1.25 | 0.125 |
| Crush Tube 2 | 7.5 | 3.00 | 0.1875 |
| Crush Tube 3 | 8.625 | 4.00 | 0.2500 |

The crush zone 24 is designed to prevent substantial damage to the vehicle in training 14 when impacted by the unmanned vehicle 12. Substantial damage to the vehicle in training 14 is any damage that would jeopardize the functionality of the vehicle in training 14 and/or require repair of the vehicle in training 14. The level of allowable damage may vary from one vehicle in training 14 to another. Consequently, the crush zone 24 of the unmanned vehicle 12 may be specifically designed for a particular vehicle in training 14. For examples where the vehicle in training 14 is a ship or vessel, vessel repair and safety guidelines may include an allowable deflection of the hull before repair is required. If such a requirement exists, the crush zone 24 may be designed to prevent a deflection above the allowable limit when the vessel is impacted by an unmanned vehicle 12.

Figure 7:
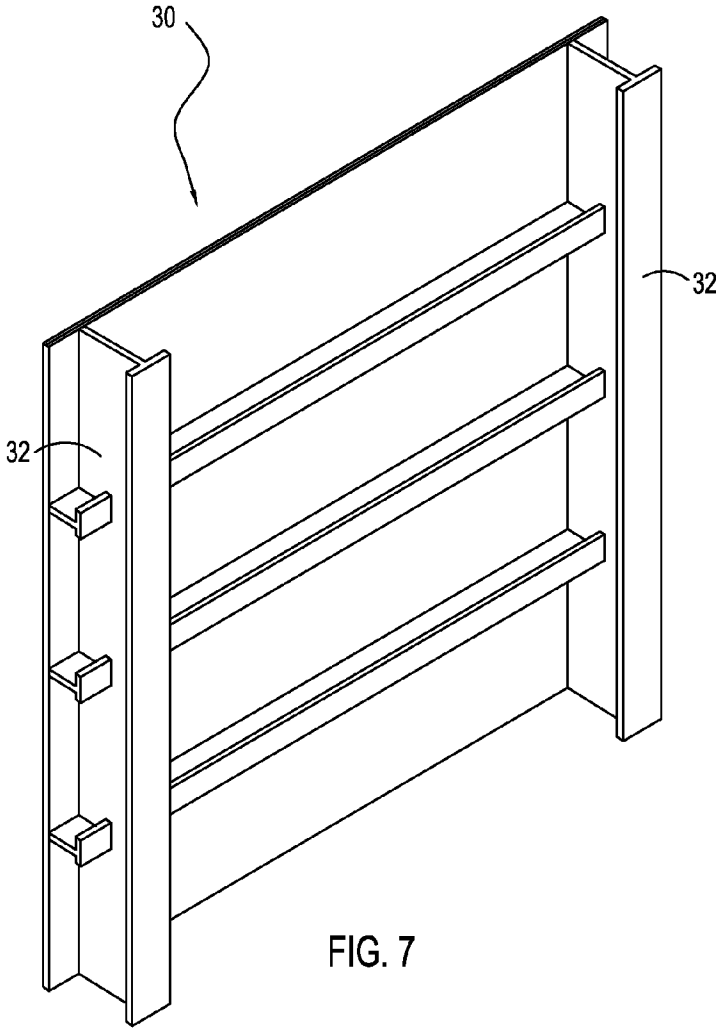
FIG. 7 illustrates one embodiment of a ship hull with vertical & horizontal spanners.

FIG. 7 illustrates one embodiment of a ship hull 30 with vertical spanners 32. Different ships may have different hull designs and FIG. 7 is provided to illustrate just one example of a ship hull. One technique to increase the effectiveness of the crush zone 24 that may be incorporated into some of the embodiments described herein, is to design the crush zone 24 to accommodate the strengths of the vehicle in training 14. For example, vessels are often designed with vertical spanners or struts 32 that give the hull 30 rigidity. In some embodiments, the minimum length of the bumper 22 may be designed to span at least two struts 32. If the bumper 22 is designed to, at a minimum span the distance between two struts 32, the bumper 22 will always strike at least one strut when impacting the hull 30. In embodiments where crushable bumpers 11 are used, the length of the bumper, or more specifically the length of the bumper box 22 or bumper contact area, may be designed to be at least equal to the distance between centerlines of the struts 32 of a vessel's hull 30.

Figure 8:
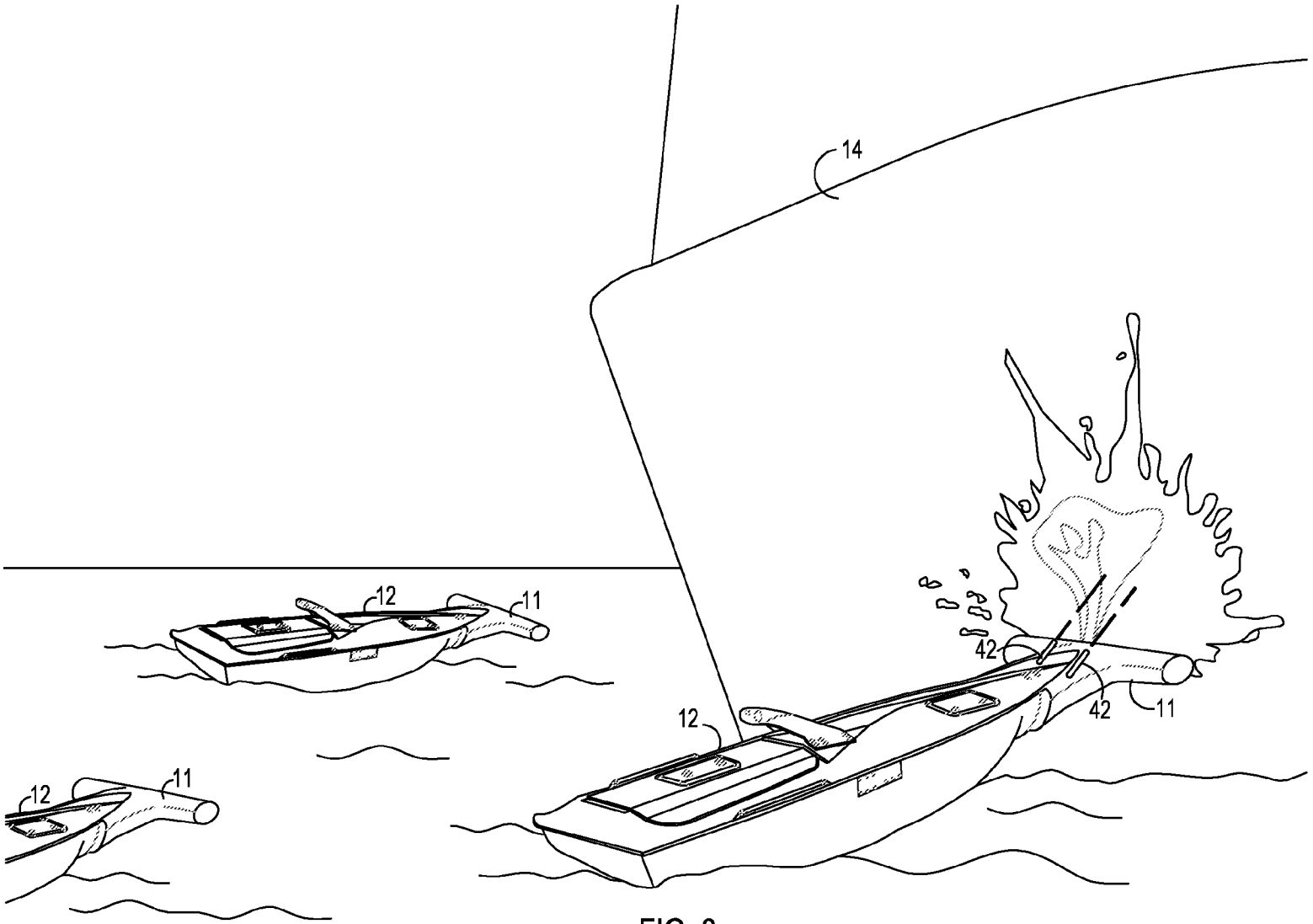
FIG. 8 illustrates one embodiment of an unmanned vehicle including a crushable bumper equipped with a marking system.

In some embodiments, the crushable bumpers 11 may include a marking system 42. FIG. 8 illustrates one embodiment of an unmanned vehicle 12 including a crushable bumper 11 equipped with a marking system 42. Marking system 42 may be any type of system designed to leave a mark on the vehicle in training 14 when impacted by the unmanned vehicle 12. By leaving a mark on the side of the vehicle in training 14 at impact, marking system 42 removes any doubt about whether the vehicle in training 14 was impacted or not. Leaving a mark on the side of the ship may not only be used as positive proof of impact but may incentivize crews to do their best to prevent their ship from being marked.

In one embodiment, the marking system 42 may be a syringe style design so that when the crushable bumper 11 buckles and collapses, the plunger portion of the syringe is compressed and the marking agent is propelled onto the side of the ship. In a preferred embodiment, the syringe marking system 42 may be angled up from the crushable bumper 11 so that the marking agent is propelled up above the waterline onto the side of the vehicle in training 14. The marking agent may be any type of ink or dye or coloring agent. Preferably, the marking agent is easily washed from the side of the vehicle in training 14.

Although the embodiments have been described with reference to preferred configurations and specific examples, it will readily be appreciated by those skilled in the art that many modifications and adaptations of the crushable device and methods therefore described herein are possible without departure from the spirit and scope of the embodiments as claimed hereinafter. Thus, it is to be clearly understood that this description is made only by way of example and not as a limitation on the scope of the embodiments as claimed below.

What is claimed is:

1. A system comprising:

a vehicle in training; and an unmanned surface vehicle designed to be remotely operated on the open water wherein the unmanned surface vehicle comprises:

a body including a hull and the hull including a bow;

a metal bumper box located in front of the bow of the unmanned surface vehicle designed to be remotely operated on the open water wherein the metal bumper box extends across the bow from a starboard side to a port side;

a first hull attachment point on a starboard side of the bow;

a second hull attachment point on a port side of the bow;

a first metal support arm that extends from the first attachment point to the starboard side of the bumper box;

a second metal support arm that extends from the second attachment point to the port side of the bumper box; and, wherein the first and second metal supports arms each include a crush zone designed and configured to buckle in order to prevent substantial damage to the vehicle in training upon impact by the unmanned surface vehicle.

2. The system of claim 1, wherein the metal bumper box further includes a shock absorbent material on its exterior.

3. The system of claim 1, wherein the crush zone includes a plurality of separate crush tubes each designed to crush under a different amount of force.

4. The system of claim 3, including a first crush tube about 7.9 inches in length with an outside diameter of about 1.25 inches and a wall thickness of about 0.125 inches and a second crush tube about 7.5 inches in length with an outside diameter of about 3 inches and a wall thickness of about 0.1875 inches and a third crush tube of about 8.625 inches in length with an outside diameter of about 4 inches and a wall thickness of about 0.25 inches.

5. The system of claim 1, wherein the crush zone is comprised of at least one crush tube designed to incur varying amounts of folding under different impact forces.

6. A method of performing a training exercise comprising the steps of:

providing the system of claim 1; and swarming the vehicle in training with the unmanned surface vehicle.

7. The method of claim 6, wherein a plurality of unmanned surface vehicles swarm the vehicle in training.

8. The method of claim 6 further including the step of marking the vehicle in training by propelling a dye onto the side of the vehicle in training when the vehicle in training is impacted by the unmanned surface vehicle.

9. The system of claim 1, wherein a width of the metal bumper box is designed to be equal to or greater than a maximum distance between two structural members of a hull of the vehicle in training.

10. The system of claim 1, wherein the crush zones each include a plurality of separate crush tubes each designed to crush under a different amount of force.

11. The system of claim 1, wherein the crush zones each include a single square crush tube designed to incur a varying number of folds based on the amount of force at impact.

12. The system of claim 1, further comprising sensors mounted on the unmanned surface vehicle designed to detect when the unmanned surface vehicle was acquired and hit by a laser system.

13. The system of claim 1, wherein the metal bumper box is stylized like a head of a hammerhead shark.

14. The system of claim 1, wherein the crush zones are made from 6063 aluminum with an O or T4 temper.

15. The system of claim 1, wherein the first metal support arm and the second metal support arm attach to the first hull attachment point and second hull attachment point with removable fasteners.

16. An unmanned surface vehicle designed to be remotely operated on the open water comprising:

a body including a hull and the hull including a bow;

a metal bumper box located in front of the bow of the unmanned surface vehicle designed to be remotely operated on the open water, wherein the metal bumper box extends across the bow from a starboard side to a port side;

a first hull attachment point on a starboard side of the bow;

a second hull attachment point on a port side of the bow;

at least one crossbeam spanning an interior of the hull between the first hull attachment point and the second hull attachment point;

a first metal support arm that extends from the first attachment point to the starboard side of the bumper box;

a second metal support arm that extends from the second attachment point to the port side of the bumper box; and, wherein the first and second metal supports arms each include a crush zone.

17. An unmanned surface vehicle designed to be remotely operated on the open water comprising:

a body including a hull and the hull including a bow;

a metal bumper box located in front of the bow of the unmanned surface vehicle designed to be remotely operated on the open water, wherein the metal bumper box extends across the bow from a starboard side to a port side;

a first hull attachment point on a starboard side of the bow;

a second hull attachment point on a port side of the bow;

a first metal support arm that extends from the first attachment point to the starboard side of the bumper box;

a second metal support arm that extends from the second attachment point to the port side of the bumper box; and, wherein the first and second metal supports arms each include a crush zone and wherein the first metal support arm and the second metal support arm are steel except for the crush zones which are aluminum.

18. An unmanned surface vehicle designed to be remotely operated on the open water comprising:

a body including a hull and the hull including a bow;

a metal bumper box located in front of the bow of the unmanned surface vehicle designed to be remotely operated on the open water, wherein the metal bumper box extends across the bow from a starboard side to a port side and wherein a shock absorbent material completely covers an exterior of the metal bumper box;

a first hull attachment point on a starboard side of the bow;

a second hull attachment point on a port side of the bow;

a first metal support arm that extends from the first attachment point to the starboard side of the bumper box;

a second metal support arm that extends from the second attachment point to the port side of the bumper box; and, wherein the first and second metal supports arms each include a crush zone.

* * * * *